US005884445A

United States Patent [19]

Woolford

[11] Patent Number: 5,884,445

[45] Date of Patent: Mar. 23, 1999

[54] PAVING BLOCK ARRAY

[75] Inventor: Michael E. Woolford, Lake Elmo, Minn.

[73] Assignee: Oldcastle, Inc., Atlanta, Ga.

[21] Appl. No.: 982,917

[22] Filed: Dec. 2, 1997

[51] Int. Cl.[6] ..... B44F 3/00; E01C 5/00; E01C 11/00

[52] U.S. Cl. ..... 52/311.2; 52/314; 52/604; 404/41; 404/42; D25/113; D25/151

[58] Field of Search ..... 52/311.2, 314, 52/315, 316, 604; 404/34, 41, 42; D25/113, 151

[56] References Cited

U.S. PATENT DOCUMENTS

| | | |
|---|---|---|
| D. 204,803 | 5/1966 | Leeth . |
| D. 257,824 | 1/1981 | Puccini et al. . |
| D. 257,825 | 1/1981 | Puccini et al. . |
| D. 272,037 | 1/1984 | Paccial . |
| D. 281,505 | 11/1985 | Larsen et al. . |

(List continued on next page.)

FOREIGN PATENT DOCUMENTS

| | | | |
|---|---|---|---|
| 570711 | 9/1958 | Belgium | 404/41 |
| 2354416 | 6/1978 | France | 404/41 |
| 3533020 | 3/1987 | German Dem. Rep. | 404/41 |
| 7122262 | 6/1971 | Germany . | |
| 7415523 | 6/1976 | Netherlands | 404/42 |
| 562921 | 6/1975 | Switzerland | 404/41 |
| 2208883 | 4/1989 | United Kingdom . | |
| 2214206 | 8/1989 | United Kingdom | 404/41 |

OTHER PUBLICATIONS

Brickform Patterns—1 sheet, undated.

Brickform Tools—Texture Mats—4 sheets, commerical literature, undated.

Uni–Group U.S.A.—Manufactures of Uni Paving Stones The Original. The Best—4 sheets of literature, undated.

Lasting Impressions in Concrete, Inc.—6 sheets of literature—undated.

Bomanite Corp.—Leadership A reputation for excellence, Innovation & Experience—5 sheets of literature, undated.

Brickform Texture Mats—2 sheets, undated.

Color Tile Advertisement, Royal Rock ceramic tile, Houston Post, Jan. 14, 1990.

Backyard Brickwork—Mike Lawrence, Ed., 1989, p. 76.

Creative Impressions, Ltd.—2 sheets—Export Price List and drawings, Apr. 1990.

Handyman's Guide to Concrete and Masonry by R.J. DeCristoforo (Copyright 1978) pp. 183–0189.

Handyman's Guide to Concrete and Masonry Handbook by R.J. Decristoforo (Published in 1960) p. 70.

Basic Masonry Illustrated, a Sunset Book (Copyright 1981) pp. 76–77.

The Complete Book of Outdoor Masonry by Duncan (Dated 1979) by Giovanni Simonis, 1977, pp. 342–345.

Patterned Concrete Industries, Inc., Specifications, undated, 3 sheets.

Exhibit G—Photocopy of front of Color Tile Royal Rock Ceramic Tile.

Exhibit H—Photocopy of rear of Color Tile Royal Rock Ceramic Tile.

Sweets General Building and Renovation, Catalog File, Anchor p. 11 "Uni–Stone" (1994)(Design Library).

*Primary Examiner*—Robert Canfield

*Attorney, Agent, or Firm*—Panitch Schwarze Jacobs & Nadel, P.C.

[57] ABSTRACT

A unitary paving block having an exposed surface in use having a multitude of markings to simulate individual, random paving elements has a periphery with a shape which enables the block to be laid with other similar blocks in an irregular, substantially unrepeated paving array. The shape of the periphery of the blocks is such that the blocks can be laid with each block angularly moved with respect to each other and/or laid in staggered relationship with respect to each other.

5 Claims, 4 Drawing Sheets

U.S. PATENT DOCUMENTS

| | | | |
|---|---|---|---|
| D. 342,528 | 12/1993 | Hupp | D15/136 |
| D. 343,237 | 1/1994 | Johnson, II . | |
| D. 349,967 | 8/1994 | Krueger et al. . | |
| D. 397,802 | 9/1998 | Terry . | |
| 653,515 | 7/1900 | Kennedy . | |
| 1,479,647 | 1/1924 | Carroll . | |
| 1,600,787 | 9/1926 | Ardit . | |
| 1,953,657 | 4/1934 | Pierce . | |
| 2,050,299 | 8/1936 | Evers . | |
| 2,606,428 | 8/1952 | Oldfather . | |
| 2,893,098 | 7/1959 | Tilley . | |
| 3,267,823 | 8/1966 | MacRae | 52/311.2 X |
| 3,600,773 | 8/1971 | Davis et al. . | |
| 3,947,192 | 3/1976 | Rosenberger | 404/41 |
| 4,026,083 | 5/1977 | Hoyt et al. . | |
| 4,078,760 | 3/1978 | Mullins . | |
| 4,105,354 | 8/1978 | Bowman . | |
| 4,131,406 | 12/1978 | Fresquez . | |
| 4,135,840 | 1/1979 | Puccini et al. . | |
| 4,231,677 | 11/1980 | Roming . | |
| 4,287,141 | 9/1981 | Russell . | |
| 4,313,689 | 2/1982 | Reinschütz . | |
| 4,354,773 | 10/1982 | Noack | 404/41 |
| 4,407,480 | 10/1983 | Trimmer et al. . | |
| 4,452,419 | 6/1984 | Saleeba . | |
| 4,510,725 | 4/1985 | Wilson . | |
| 4,609,303 | 9/1986 | Shumaker . | |
| 4,627,764 | 12/1986 | Scheiwiller . | |
| 4,773,790 | 9/1988 | Hagenah | 404/41 |
| 4,776,723 | 10/1988 | Brimo . | |
| 4,828,426 | 5/1989 | Hendricks et al. . | |
| 4,838,728 | 6/1989 | McKeever . | |
| 4,921,372 | 5/1990 | Hybertson . | |
| 5,051,023 | 9/1991 | Yoshida et al. . | |
| 5,211,895 | 5/1993 | Jacklich, Sr. . | |
| 5,230,584 | 7/1993 | Grossman . | |
| 5,281,047 | 1/1994 | Skaug | 404/42 |
| 5,286,139 | 2/1994 | Hair . | |
| 5,487,526 | 1/1996 | Hupp | 249/2 |
| 5,496,129 | 3/1996 | Dube . | |

PAVING BLOCK ARRAY

FIELD OF THE INVENTION

This invention relates to paving blocks and more particularly to what is known in the art as random paving.

BACKGROUND OF THE INVENTION

Random paving consists of different sized, individual blocks which are laid together so as to produce an irregular, unrepeated effect which is visually pleasing.

The problem encountered with random paving is the multiplicity of paving blocks which have to be first matched and then laid individually. Unfortunately, the finished appearance is entirely dependent on the skill of the person laying the paving; there is no guarantee that the end result will be in harmony with the environment and will achieve a sufficient level of randomness. Even with the most skilled and efficient layers, the time taken to lay such paving makes it extremely costly and all too often the ultimate result is not as aesthetically pleasing as random paving should be. Furthermore, there is a tendency with time and continued traffic for certain individual blocks to shift in relation to one another resulting in the occurrence of unsightly cracks, the effect usually being worsened by the subsequent growth of weeds through the cracks, which in turn further increases the crack size. The only way of satisfactorily halting such deterioration is to replace the whole area of paving, which solution is not only expensive but is also disruptive to traffic in its vicinity.

Despite these problems, random paving has enjoyed a come back in recent years, particularly in places which are being redeveloped and restored such as riverside, warehouse and docks areas, where old buildings or their facades are left in place. This is because random paving is in harmony and in keeping with and sympathetic to the old environment which has been newly restored.

For ease of laying, consideration has been given to producing a unitary paving blocks having markings on its upper surface to simulate random paving elements of different dimensions and with an external periphery having a shape which enables other similar blocks to be laid in opposite side to opposite side relationship. Moreover, U.S. Pat. No. Design 342,528 and U.S. Pat. No. 5,487,526 both to Hupp each discloses a patterned mould for moulding such unitary paving blocks in situ to create concrete pathways. The paving blocks are created by filling the mould with wet concrete in situ and subsequently removing the mould to reveal the paving blocks having surface impressions simulating the random paving. The mould has a periphery which enables it to be matched with the blocks previously formed in the wet concrete in opposite side-to-opposite side relationship.

Although careful laying of concrete using these moulds can overcome problems such as movement and resulting cracking, and hence the need for untimely replacement of individual random paving elements, the moulds still have the disadvantage that they cannot reproduce the irregular, unrepeated effect that can be obtained with individual paving elements. Moreover, this method of moulding wet concrete in situ still relies upon the skill of the layer and his speed of application.

This skill will involve subjecting the wet concrete to similar pressures for each moulding, otherwise too great a pressure might result in the mould cutting through the concrete bed and if too light might result in the impressions being too shallow thus failing to provide the desired aesthetically pleasing effect. Not only this, whole areas have to be fenced off to allow the concrete to set before it can be walked upon and the areas have to be covered to guard against the effects of rain.

SUMMARY OF THE INVENTION

Accordingly, the main object of the present invention is to provide a unitary paving block having markings thereon to simulate individual paving elements of different dimensions and which when laid with other similar blocks can reproduce the irregular, unrepeated, aesthetically pleasing, environmentally harmonious and sympathetic effects that can be obtained with individual paving elements.

To this end, the present invention resides in a unitary paving block presenting an exposed surface having a plurality of markings thereon to simulate individual, random paving elements, said paving block having a periphery which enables the block to be laid together with other similar blocks to form a paving array, the improvement which comprises:

providing said periphery with a shape which enables said block to be laid together with other similar blocks in an irregular, substantially unrepeated, random paving array.

By means of the invention not only are the problems with movement and cracking substantially prevented, but it is also possible to reproduce a truly random paving effect which has hitherto long been sought for in vain.

The random paving array can be effected in a number of different ways. For example, the periphery can be shaped so that the individual unitary paving blocks can be staggered and/or angularly moved with respect to each other.

When the paving blocks are staggered and angularly moved, an almost infinite variety of irregular, substantially unrepeated, random paving arrays can be laid. Thus the shape of the periphery may be such that the paving blocks can be laid in side-by-side, end-to-end, and end-to-side relationship. In other words, any side and any end of one block can be laid next to any side and any end of adjacent similar block, and in either an aligned or staggered relationship.

In a preferred embodiment the paving block is of generally rectangular configuration, preferably generally square, of which each side has at least two depressions therein and at least three peaks which define the respective depressions therebetween.

The invention also resides in a laid random paving array of any of the paving blocks according to the invention as defined hereinabove.

BRIEF DESCRIPTION OF THE DRAWINGS

In order that the invention may be readily understood, an embodiment thereof will now be described by way of example with reference to the accompanying drawings in which.

DETAILED DESCRIPTION OF THE PREFERRED EMBODIMENTS

Figure 1:
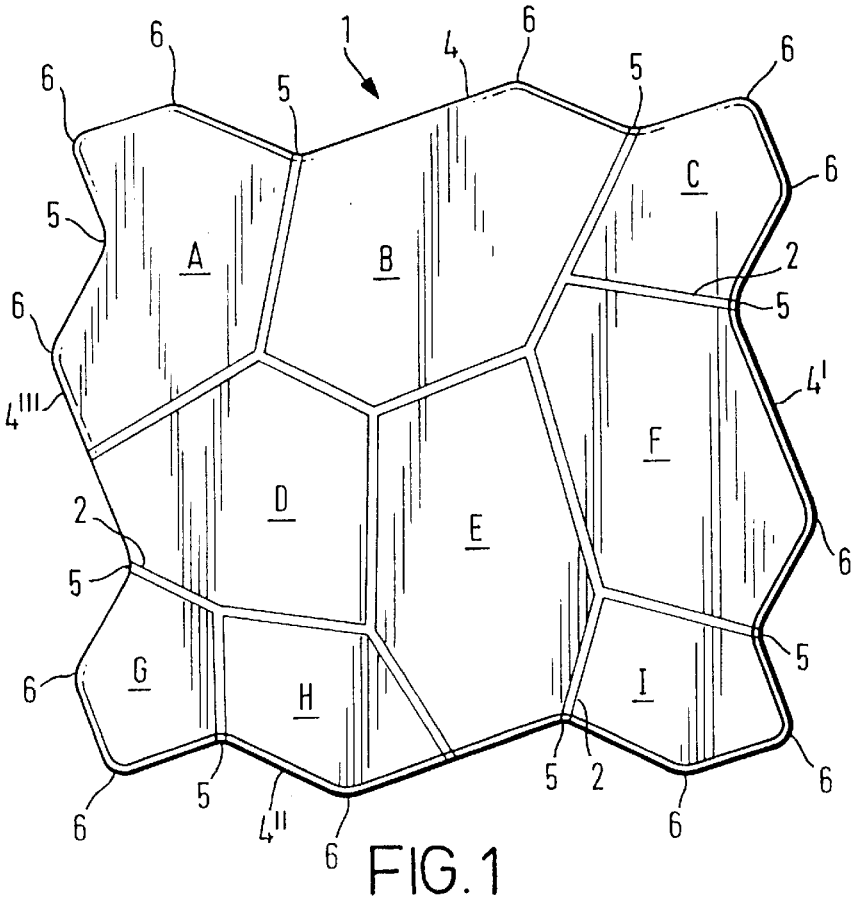
FIG. 1 is a top plan view of a paving block constructed according to the invention.
Figure 2:
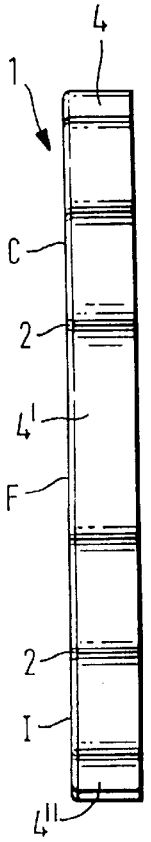
FIG. 2 is a right side elevational view thereof.
Figure 3:
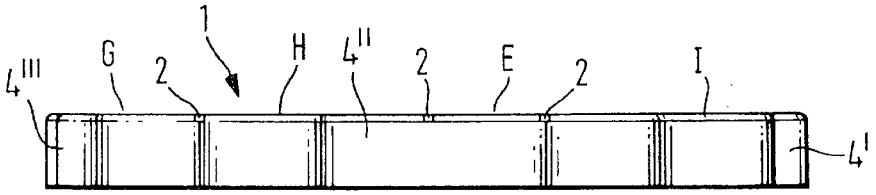
FIG. 3 is a front elevational view thereof.
Figure 4:
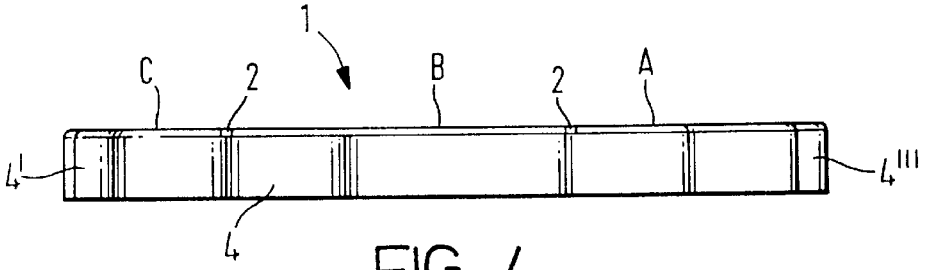
FIG. 4 is a rear elevational view thereof.

Referring to FIG. 1 of the drawings, there is shown the exposed surface in use of a random paving block generally indicated at 1 and which comprises nine individual, asymmetric, random paving elements designated by the references A,B,C,D,E,F,G,H and I which form an integral whole with the block 1. Between the paving elements A–I there are elongate recesses 2 which simulate the mortar gaps between individually laid random paving elements.

The block 1 is of substantially square configuration with each side 4,4',4",4'" having two depressions commonly indicated by reference numeral 5 interposed between three peaks commonly indicated by reference numeral 6.

Figure 5:
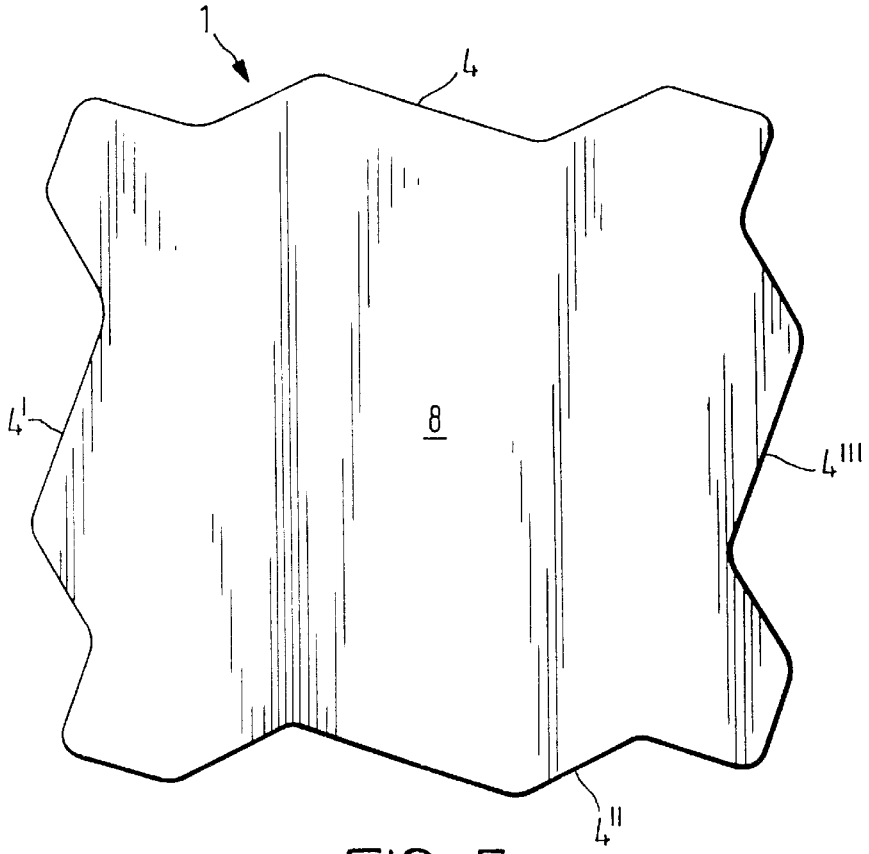
FIG. 5 is a bottom plan view thereof.
Figure 6:
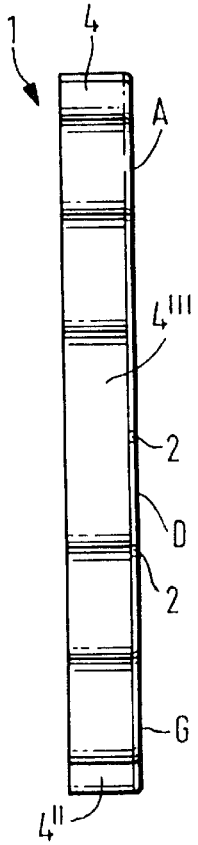
FIG. 6 is a left side elevational view thereof.

Elevational views from each of the sides 4,4',4",4'" are shown in FIGS. 2,3,4 and 6 and a bottom plan view is shown in FIG. 5. As will be apparent from the elevational views, each of the sides 4,4',4",4'" correspond closely to each other to enable any side of one block to align with any side of an adjacent block. The underside 8 of the block as shown in FIG. 5 is substantially planar being devoid of recesses.

Figure 7:
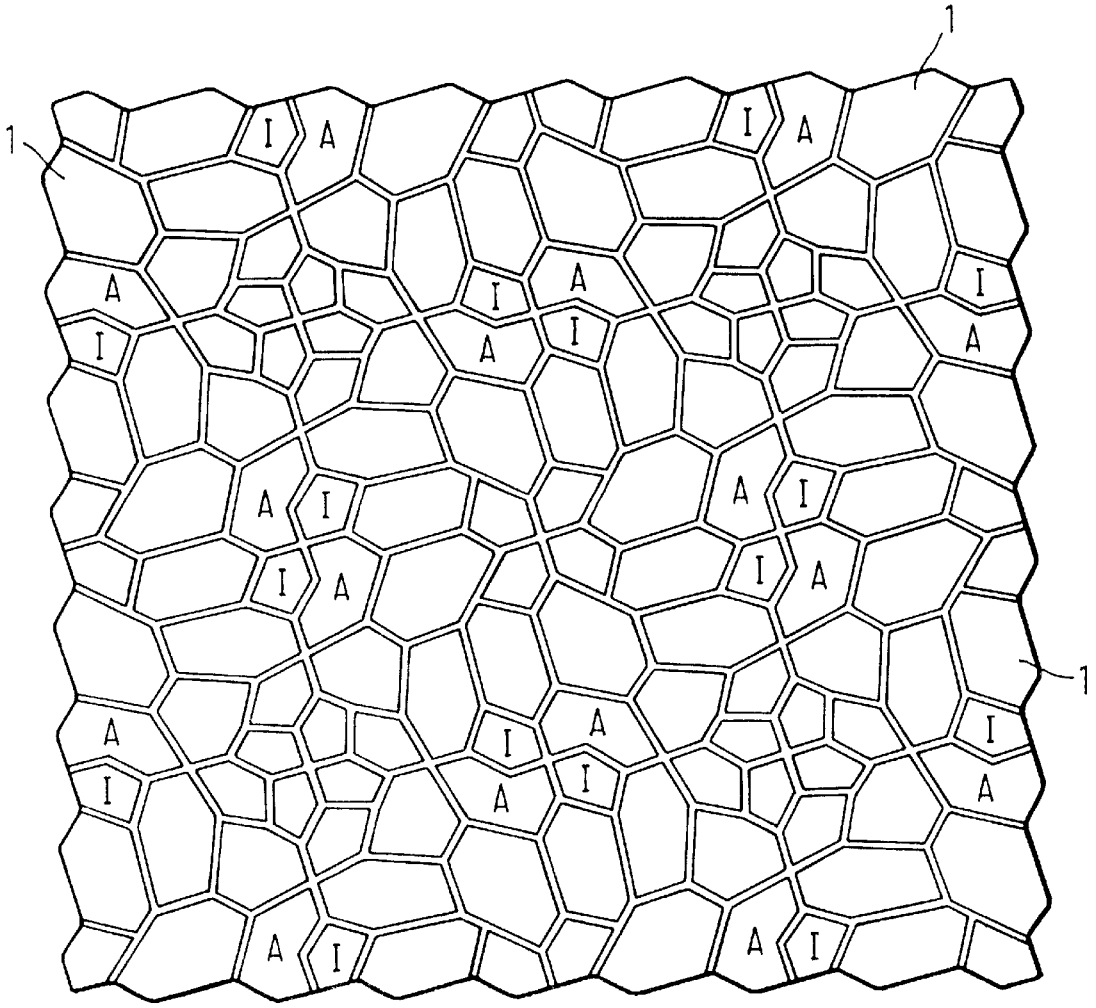
FIG. 7 is a paving array of paving blocks of FIG. 1, laid with individual paving blocks angularly moved with respect to one another.

A multitude of blocks 1 laid in an irregular paving array are shown in FIG. 7. The blocks are arranged in four different angular orientations with respect to each other, each block being in 90°, 180° or 270° relationship to an adjacent block. For simplicity, only the positions of random paving elements A and I are labelled.

Figure 8:
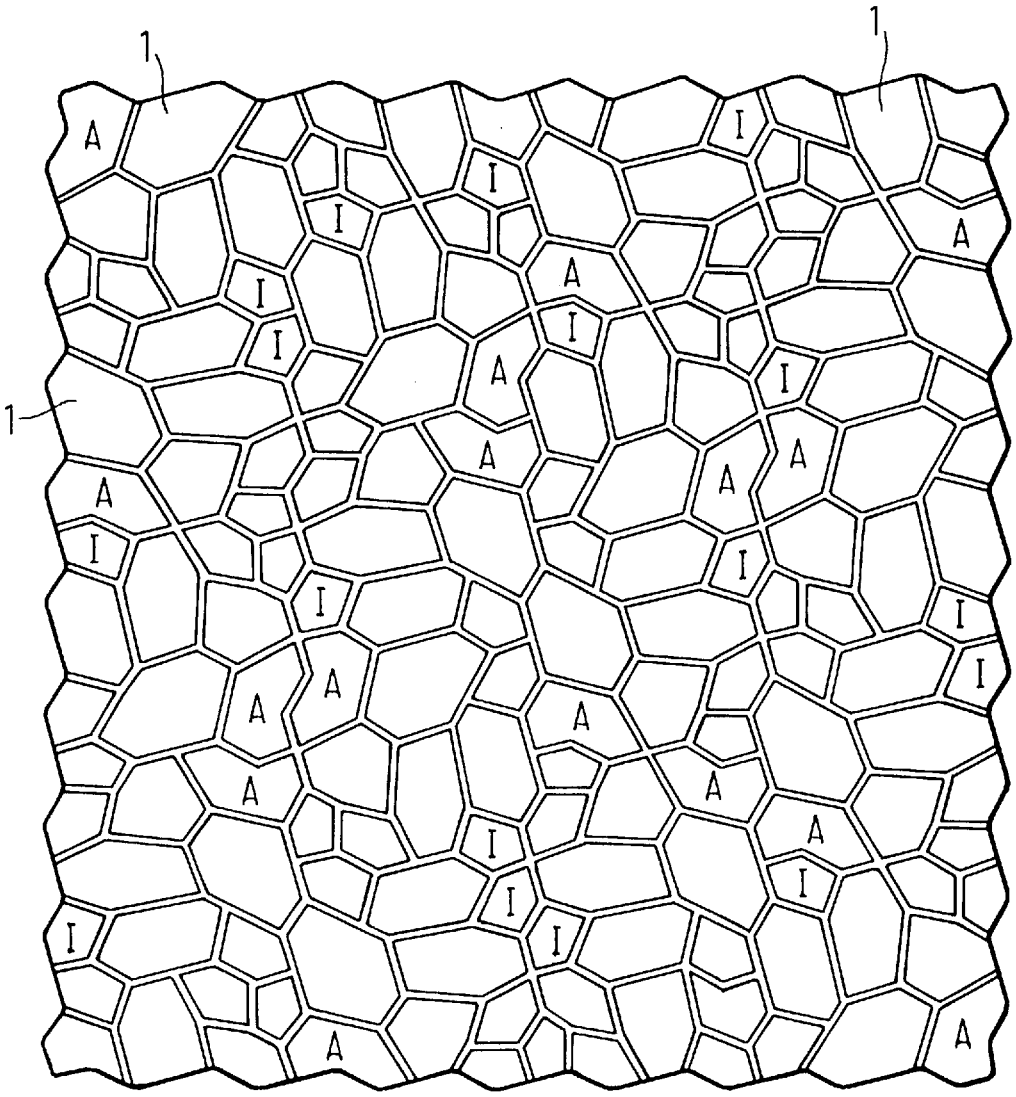
FIG. 8 is another paving array of paving blocks of FIG. 1, laid with individual paving blocks angularly moved and staggered with respect to one another.

An alternative arrangement of the same blocks 1 is shown in FIG. 8. This time, not only are the blocks 1 angularly moved relative to each other, but the blocks 1 are also laid in staggered relationship, to produce a completely random paving array. Again, only the positions of random paving elements A and I are shown.

The present invention may be embodied in other specific forms without departing from the spirit or essential attributes thereof and, accordingly, reference should be made to the appended claims rather than the foregoing specification as indicating the scope of the invention. For example, different periphery shapes may be adopted and similarly the number and asymmetry of the markings on the exposed surface may be altered.

I claim:

1. An array of paving blocks comprising a plurality of paving blocks, the blocks having an exposed surface having a plurality of markings thereon to simulate individual, random paving elements, the blocks further having a generally rectangular configuration with an edge contour in which each side has at least two depressions therein and at least three peaks which define the respective depressions therebetween, wherein the blocks are laid to form an irregular, substantially unrepeated random array, and wherein the blocks are laid in a substantially abutting fashion such that the edge contour of each block follows the edge contour of adjacent blocks.

2. The array of claim 1 wherein the edge contour of each paving block is shaped such that the blocks can be laid in at least one of a staggered relationship and an angular relationship with respect to each other.

3. The array of claim 1 wherein the edge contour of each paving block is shaped such that the blocks can be laid in side-by-side, end-to-end, and end-to-side relationship with respect to each other.

4. The array of claim 1 wherein each paving block is of generally square configuration.

5. The array of claim 1 wherein each side of each paving block has two depressions therein and three peaks which define the respective depressions therebetween.

* * * * *